United States Patent [19]

DuBiel et al.

[11] 4,152,855

[45] May 8, 1979

[54] RIFLE BOLT LOCKING APPARATUS

[76] Inventors: Joseph T. DuBiel, 1724 Baker Rd., Sherman, Tex. 75090; John P. Tyson, 105 Memorial Dr., Denison, Tex. 75020

[21] Appl. No.: 891,048

[22] Filed: Mar. 28, 1978

Related U.S. Application Data

[63] Continuation of Ser. No. 709,397, Jul. 28, 1976, abandoned.

[51] Int. Cl.[2] ..... F41C 11/06

[52] U.S. Cl. ..... 42/16

[58] Field of Search ..... 42/16

[56] References Cited

U.S. PATENT DOCUMENTS

| | | | |
|---|---|---|---|
| 2,481,548 | 9/1949 | Waltke, Jr. | 42/16 |
| 2,685,754 | 8/1954 | Crittendon et al. | 42/16 |
| 3,027,672 | 4/1962 | Sullivan | 42/16 |
| 3,030,722 | 4/1962 | Ivy | 42/16 |
| 3,253,362 | 5/1966 | Gitchell | 42/16 |
| 3,274,724 | 9/1966 | Brandt | 42/16 |
| 3,494,216 | 2/1970 | Haskins | 42/16 |

*Primary Examiner*—Charles T. Jordan
*Attorney, Agent, or Firm*—David H. Hill

[57] ABSTRACT

A receiver and bolt for a rifle wherein both the receiver and the bolt contain mating lugs of equal spacing around the receiver and bolt. The width of the lugs on the receiver at their attachment to the receiver and the spacing between the lugs are equal. Additional locking lugs can be attached behind the first-mentioned lugs to provide additional restraining force capability. The lugs should be mounted on an angle of 90° to 72° as calculated from a plane normal to the axis of the bolt or receiver.

2 Claims, 6 Drawing Figures

RIFLE BOLT LOCKING APPARATUS

This is a continuation of application Ser. No. 709,397, filed July 28, 1976, now abandoned.

BRIEF DISCUSSION OF THE PRIOR ART

Locking lugs have been utilized in previous bolt and receiver mechanisms. Such devices generally fall into two classes—those patents that utilize two or three locking lugs such as U.S. Pat. Nos. 3,494,216 to Haskins; 3,274,724 to Brandt; 1,932,424 to Simpson et al; 3,631,620 to Banri Ohira; and 3,330,061 to Koon, Jr., or those patents where more than three lugs are employed but the spacing is unequal and the lug width varies, such as U.S. Pat. Nos. 3,030,722 and 2,967,367 to Ivy.

The three-lug concept requires too much rotation to be satisfactory for the proposed action, since the bolt must be rotated 60° in order to unlock it from the mating lugs on the receiver. In order to reduce the rotational requirements, the width of the lugs was greatly reduced which also reduced the restraining capabilities of the lugs.

When the number of lugs was increased, the spacing or width became unequal, thereby also reducing the restraining capabilities of the lugs.

BRIEF DESCRIPTION OF THE INVENTION

It is an object of this invention to provide the maximum holding or restraining capabilities in the lugs while maintaining a minimum rotational requirement for the bolt and, in addition, providing a simple means for camming the firing mechanism into a recocked position ready for firing when the bolt is counterrotated into a locked position. The above is accomplished by providing lugs around the receiver in equally spaced locations, the width of the lugs at the attachment location and the spacing of the lugs between attachment positions being equal. The bolt carries mating lugs dimensioned to slidably fill the space between the receiver lugs, thereby giving the locked combination the maximum possible holding or restraining capabilities. A cam on the bolt handle cooperates with a cam on the rear portion of the receiver to cock the firing pin spring and reset the trigger mechanism of the rifle.

DETAILED DESCRIPTION OF THE INVENTION

Figure 4:
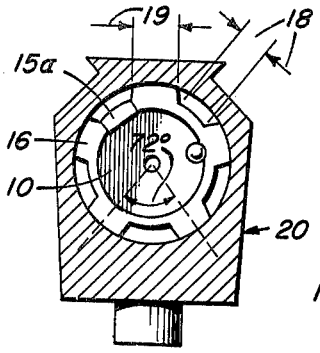
FIG. 4 is a cross-sectional view taken through 4—4 of FIG. 3.
Figure 1:
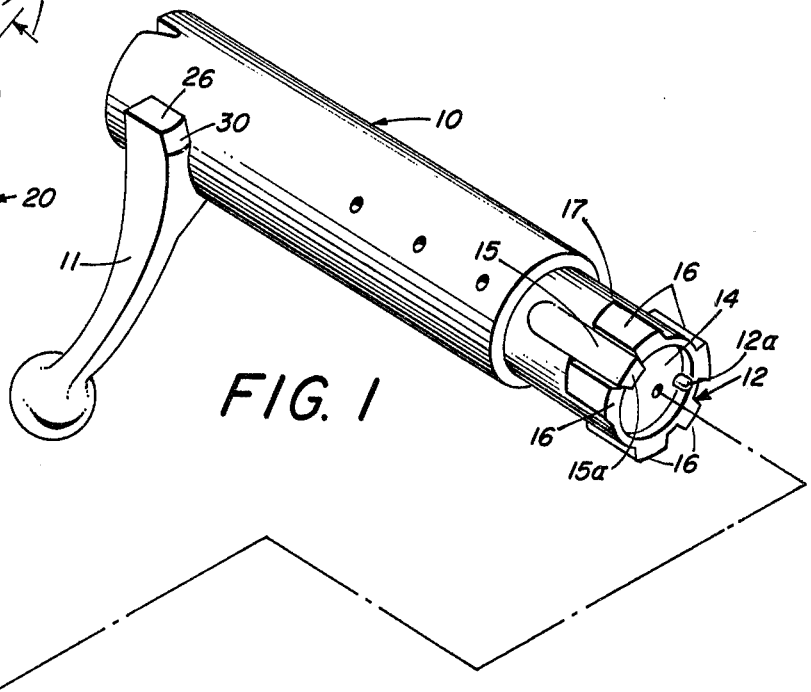
FIG. 1 is a perspective view of the bolt removed from the receiver to illustrate the lug placement and the lug dimensions.

Referring to all of the drawings but in particular to FIGS. 1-5, a bolt 10 is illustrated having a bolt handle 11 attached thereto. Bolt 10 has a forward end generally referred to by arrow 12. Forward end 12 includes a recessed portion 14 for receiving the base of a shell.

Extractor mechanism 15 is attached to the side of the bolt 12 and has a lip **15*a* which extends into recessed portion 14** for removing a shell once it has been fired. All of the above is well known in the art and will not be explained further in detail.

A novel bolt locking mechanism comprises a plurality of lugs 16—either 4 or 5—equally spaced around the periphery 17 of the forward end 12 of bolt 10. Referring to FIG. 4, the spacing 18 between each of the lugs 16 equals the width 19 of each of the lugs. This arrangement will create the greatest holding force or restraining capabilities of the bolt against backward movement of the bolt when a shell is fired.

Figure 2:
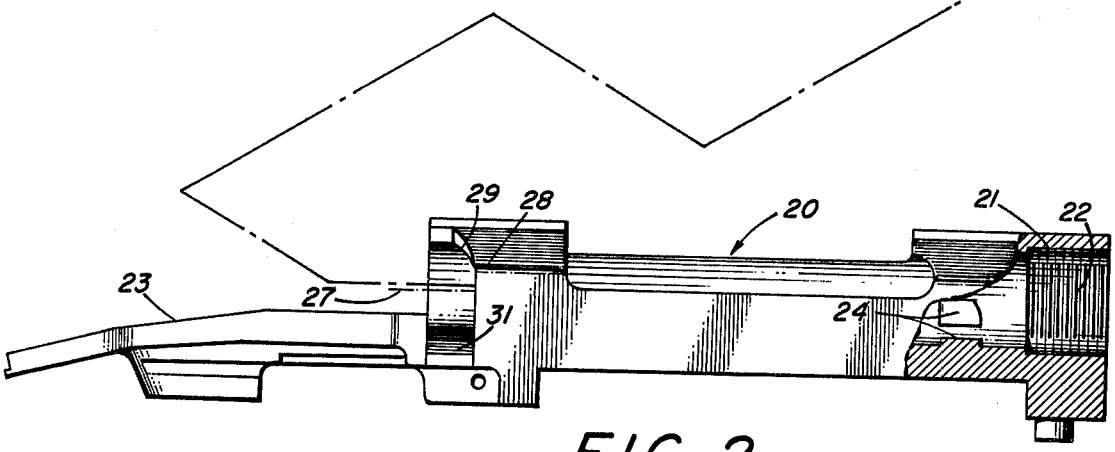
FIG. 2 is a side view in partial section of the receiver with the bolt removed.
Figure 3:
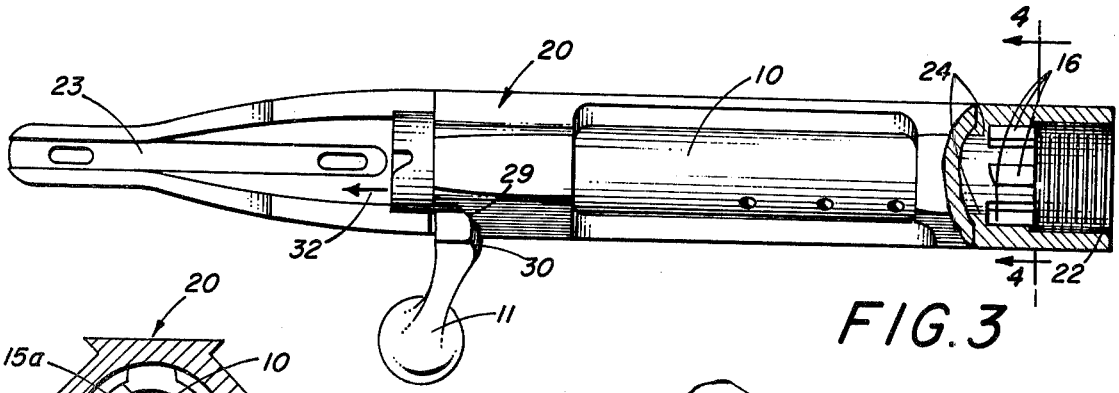
FIG. 3 is a top view in partial section of the bolt and receiver assembled.

Referring to FIGS. 2 and 3 in particular, a receiver generally referred to by arrow 20 includes a forward end 21 having a threaded socket 22 adapted to receive a rifle barrel (not shown) which is screwed into threaded socket 22 in the usual manner. A rear portion includes a mounting extension 23 used to attach the receiver to a rifle stock (not illustrated). All of the above is well known in the art and will not be further described.

Referring to forward end 21, a plurality of lugs 24 is illustrated which are attached or milled to the inside cylindrical surface of receiver 20. Each of the lugs 24 is adapted to mate with the lugs 16 on bolt 10. Lugs 16 and 24 are such that the lugs on bolt 10 just slidably fill the space between lugs 24 on receiver 20. This construction will create the greatest possible restraining force against backward movement of bolt 10 in receiver 20 when an axial force is created by a fired bullet in the rifle.

The top 26 of bolt handle 11 is represented by dotted lines 27 in FIG. 2. The rotational distance between the dotted line 27 and the bottom 28 of cam surface 29 will equal one-half the number of degrees spacing the lugs 24 or 16. Where 5 lugs are used, the spacing will be 72°, hence the bolt will be rotated only 36°.

As bolt handle 11 is rotated upward, a cam surface 30 on handle 11 will strike cam surface 29 on receiver 20. When handle 11 is continued in its upward rotation, bolt 10 will move rearwardly in the direction of arrow 32 causing the firing pin spring mechanism (not shown) to be recocked. As bolt 10 is continued in the direction of arrow 32, the spent shell will be released by extracting apparatus 15 in cooperation with pin **12*a*** and discarded. A new bullet will enter the chamber and be forced into the barrel in the usual manner.

Radial slot 31 is dimensioned to snugly receive bolt handle 11 when handle 11 is rotated downwardly, thereby adding additional restraining force against backward movement of bolt 10 when a shell is fired.

Figure 5:
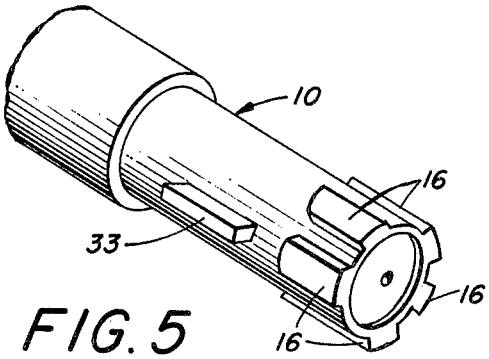
FIG. 5 is a perspective view of a portion of the bolt shown in FIG. 1 illustrating a second lug means mounted behind the first row of lugs.

A modification of the locking lugs is illustrated in FIG. 5 where a second lug 33 is positioned axially in line with one of the lugs 16 on bolt 10. While only one lug is illustrated, it is obvious that a plurality of lugs could be spaced around bolt 10, the number not exceeding the number of lugs 16. The spacing between lugs 16 and 33 will be occupied by lugs 24 on receiver 20. Several additional rows of lugs 33 can be spaced along bolt 10 and receiver 20.

Figure 6:
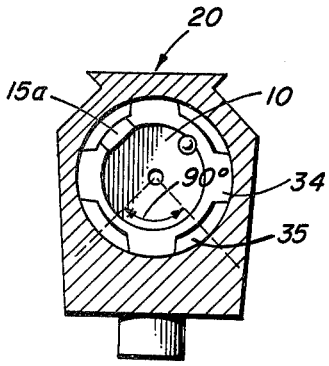
FIG. 6 is a modified version of the lug arrangement shown in FIGS. 1 through 5.

Referring to FIG. 6, a modification of the lug arrangement is illustrated. Rather than 5 lugs, 4 lugs 34 are formed on bolt 10 and corresponding mating lugs 35 on receiver 20. With 4 lugs the mounting angle between lugs will be 90° requiring the bolt 10 to be rotated 45° in order to unlock lugs 34 from lugs 35.

It is obvious that changes and modifications can be made in the apparatus as described in the specification and appended claims and still be within the spirit and scope of this invention.

What I claim is:

1. In a manually cocked firearm having a substantially cylindrical bolt and a cooperating receiver in which said bolt is rotatable and longitudinally slidable between a forward firing position and a rearward cocked position, a locking apparatus for locking said bolt in said forward firing position, comprising:

five circumferentially aligned solid locking lugs of equal longitudinal length integral with said bolt and equally spaced about the outer surface of said bolt contiguous with the forward end thereof, the circumferential width of each of said lugs being substantially thirty-six degrees, five circumferentially aligned cooperating locking lugs of equal longitudinal length equally spaced about the inner surface of said cooperating receiver adjacent the forward end thereof, the circumferential width of each of said cooperating lugs being substantially thirty-six degrees, the circumferentially aligned forward ends of said cooperating locking lugs being positioned rearwardly of the forward end of said receiver a distance at least equal to the longitudinal length of said locking lugs on said bolt, and, a bolt handle positioned rearwardly on said bolt for manual manipulation of said bolt between a forward firing position in which respective ones of said locking lugs are positioned forwardly of and in aligned abutment with respective ones of said cooperating locking lugs, and a rearward cocked position achieved by rotation of said bolt substantially thirty-six degrees relative to said receiver and longitudinal movement therebetween with said locking lugs and said cooperating locking lugs in interdigitated sliding relationship.

2. In a gun having a substantially cylindrical bolt and a cooperating receiver in which said bolt is rotatable and longitudinally slidable between a forward firing position and a rearward cocked position, a locking apparatus in accordance with claim 1, and including a radial slot in said receiver adapted to receive said bolt handle and thereby lock it against longitudinal movement when said bolt is in the forward firing position in said receiver.

* * * * *